US006398871B1

(12) United States Patent
Hur

(10) Patent No.: US 6,398,871 B1
(45) Date of Patent: Jun. 4, 2002

(54) APPARATUS FOR PAINTING DOOR OF VEHICLE

(75) Inventor: Jin Hur, Asan-shi (KR)

(73) Assignee: Hyundai Motor Company, Seoul (KR)

( * ) Notice: Subject to any disclaimer, the term of this patent is extended or adjusted under 35 U.S.C. 154(b) by 40 days.

(21) Appl. No.: 09/593,962

(22) Filed: Jun. 15, 2000

(30) Foreign Application Priority Data

Dec. 17, 1999 (KR) ..... 1999-58737

(51) Int. Cl.[7] ..... B05C 5/02; B05C 13/02

(52) U.S. Cl. ..... 118/323; 118/500; 118/503; 901/43; 414/737

(58) Field of Search ..... 118/323, 500, 118/503; 901/43; 414/737

(56) References Cited

U.S. PATENT DOCUMENTS 5,286,160 A * 2/1994 Akeel et al. ..... 414/744.3
5,318,254 A * 6/1994 Shaw et al. ..... 901/43
5,941,679 A * 8/1999 Foti et al. ..... 414/737

* cited by examiner

*Primary Examiner*—Laura Edwards
(74) *Attorney, Agent, or Firm*—Birch, Stewart, Kolasch & Birch, LLP

(57) ABSTRACT

An apparatus for painting the door of a vehicle comprising a painting robot having a door open/close jig, including a supporting bar elastically supported by a spring and a permanent magnet; and a holding unit for a door panel having a height control cylinder for controlling the height thereof, a moving cylinder for holding or releasing the door opened, a rotor connected with the moving cylinder, and a guide shaft mounted on an end of the rotor and having a holder provided a plurality of recesses for holding the door panel on its surface. The apparatus does not require a separate door open/close robot that is expensive and the revising work during the painting process.

5 Claims, 5 Drawing Sheets

APPARATUS FOR PAINTING DOOR OF VEHICLE

FIELD OF THE INVENTION

The present invention relates to an apparatus for painting the door of vehicle, more particularly relates to an apparatus for painting the door of vehicle that can paint the door of a vehicle with only a painting robot without using a door open and close robot.

BACKGROUND OF THE INVENTION

Generally, the painting booth for a vehicle provides a painting base process and a painting clear process. After the work of the painting booth is completed after a preparation process, an electrodepositing paint process and a mid-painting process are performed. Then inspection process and assembling process are conducted.

FIG. 6 shows a schematic diagram of a prior painting booth for a vehicle. As shown in FIG. 6, in the prior painting booth, the painting work is prepared by the operator 10 in the preparation room, and the engine room, the inner plate of the hood, the inside of the trunk, the inner plate of the trunk lid, and the inner plate of the door of the vehicle are painted by a door open/close robot 22 and a painting robot 20.

The unpainted portion of the inner-plate base is revised during an inner-plate base revising process. And an outer panel such as the door panel of the vehicle is painted in an outer plate base process.

Next, an inner plate clear process and an outer plate process are done and identified by the operator 10.

During the inner plate base process, the door open/close robot opens the door and the painting robot paints the door trim that is an inner plate of the door.

The prior painting booth must be provided with both the door open/close, robot and the painting robot. And the door open/close robot is very expensive and is often out of order.

After the inner plate base process, the revising process for the inner plate base must be performed and the inner clear process must be confirmed and revised.

SUMMARY OF THE INVENTION

The object of the present invention is to provide an apparatus for painting the door of a vehicle that does not require a separate door open/close robot that is expensive, and the revising work during the painting process.

The present invention to achieve the above object comprises a painting robot having a door open/close jig, which includes a supporting bar elastically supported by a spring and a permanent magnet; and a holding unit for a door panel having a height control cylinder for controlling the height thereof, a moving cylinder for holding or releasing the door opened, a rotor connected with the moving cylinder, and a guide shaft mounted on an end of the rotor and having a holder provided a plurality of recesses for holding the door panel on its surface.

The door open/close jig is made of urethane material. And the holder is releasably engaged with the guide shaft through a tooth portion.

Furthermore, the holder is made of acetal resin material and elastically supported by the spring so that the surface of the door painted is not injured and scratching does not occur.

BRIEF DESCRIPTION OF THE DRAWINGS

The above object and other advantages of the present invention, will become more apparent by describing in detail the preferred embodiment of the present invention with reference to the attached drawings in which.

DETAILED DESCRIPTION OF THE PRESENT INVENTION

Figure 1:
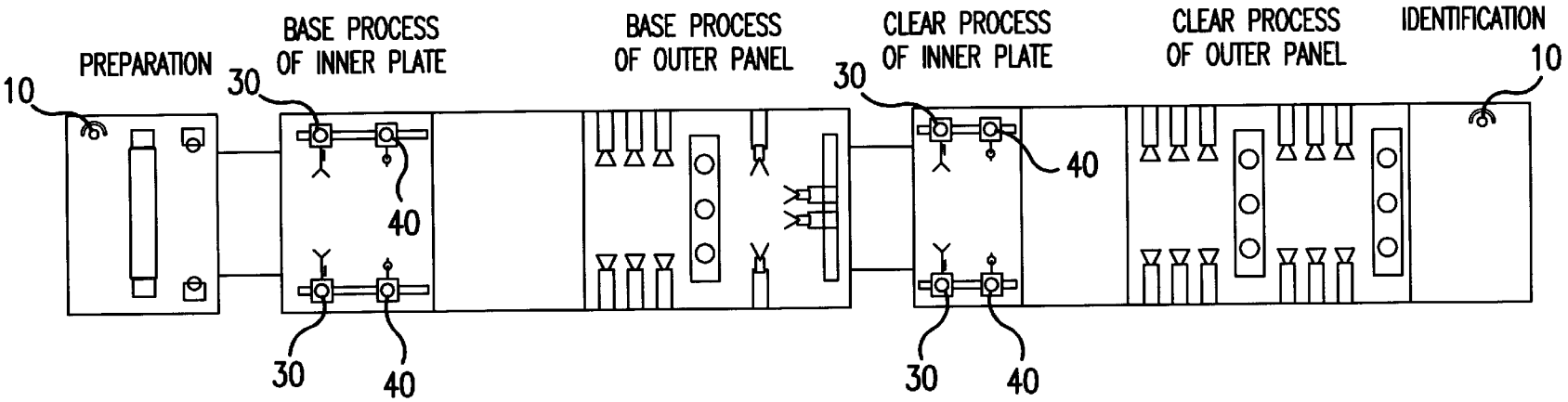
FIG. 1 is a schematic diagram of an unmanned painting booth for a vehicle in accordance with the present invention.
Figure 2:
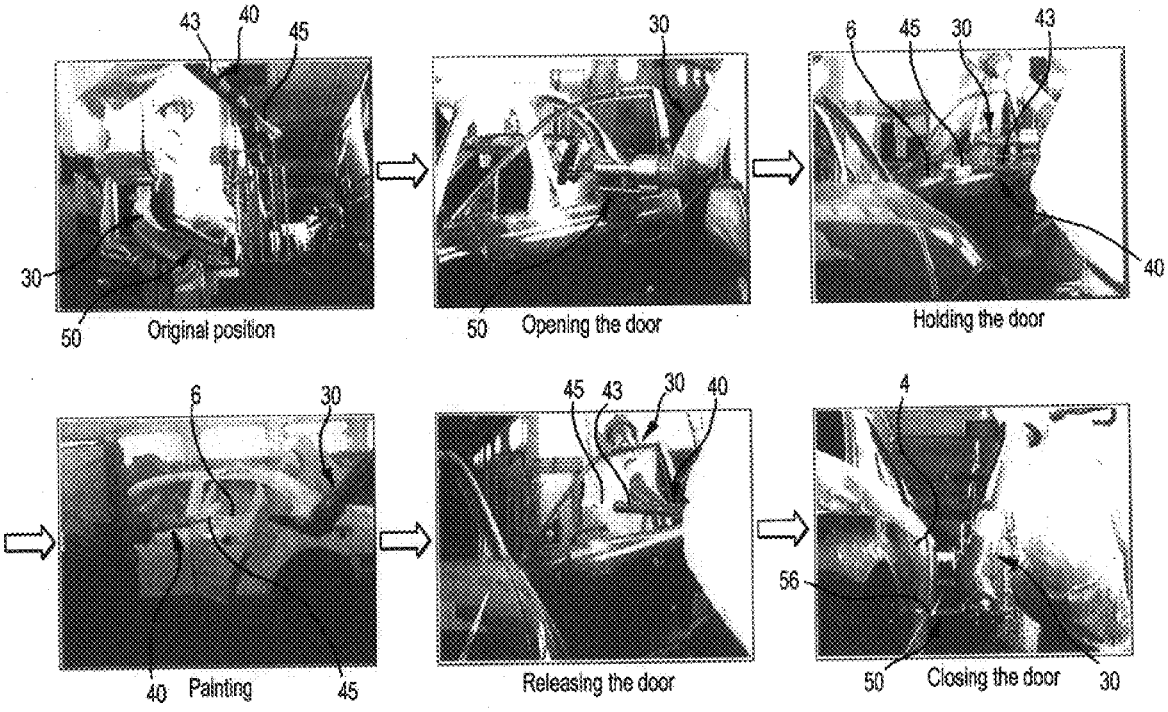
FIG. 2 show the operating flow diagram of the painting booth for vehicle in accordance the present invention.
Figure 3:
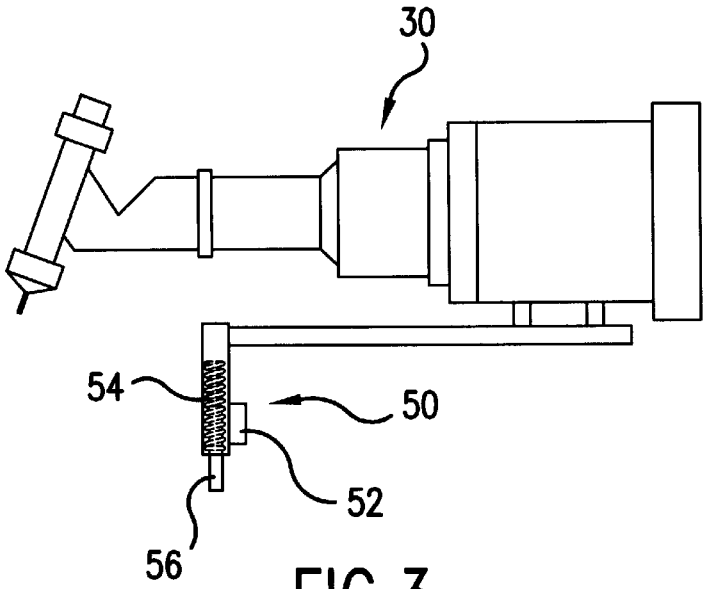
FIG. 3 is a partial sectional view of the painting robot in accordance with the present invention.
Figure 5:
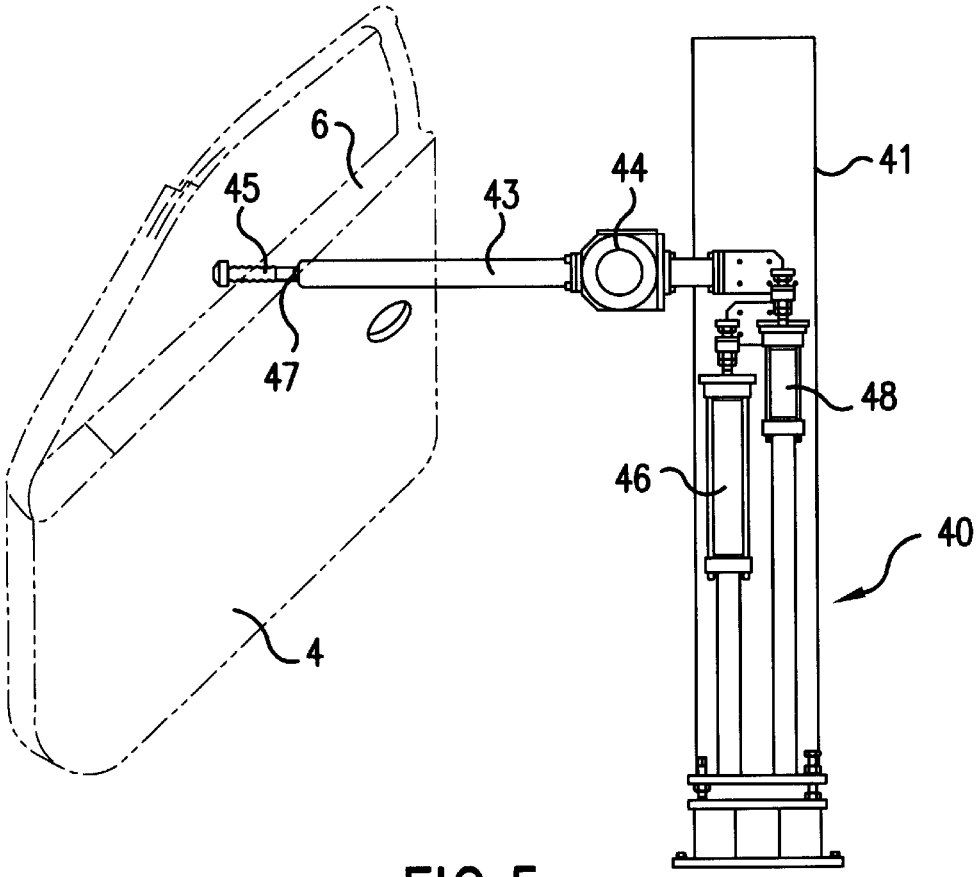
FIG. 5 is a partial section view of the door holding unit in accordance with the present invention.
Figure 4A:
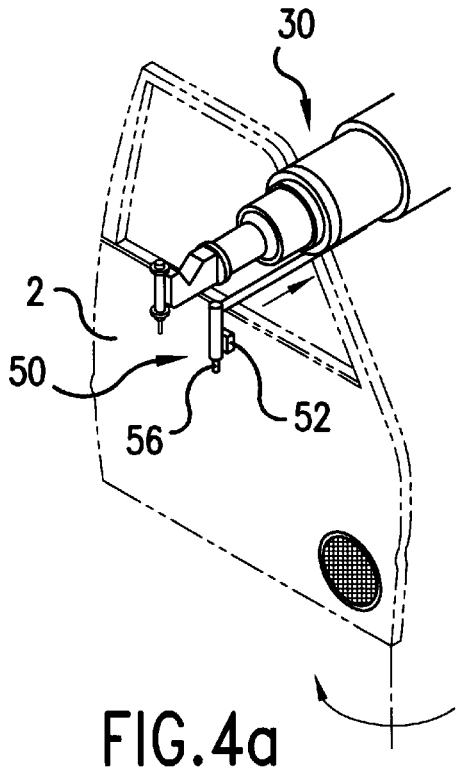
FIGS. 4*a* and 4*b* show the operating state of the painting robot in accordance with the present invention.
Figure 4B:
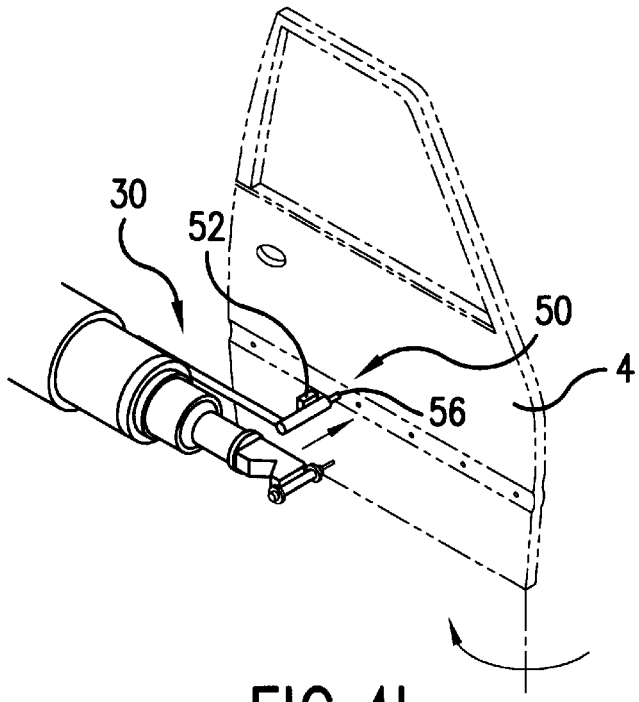
Figure 6:
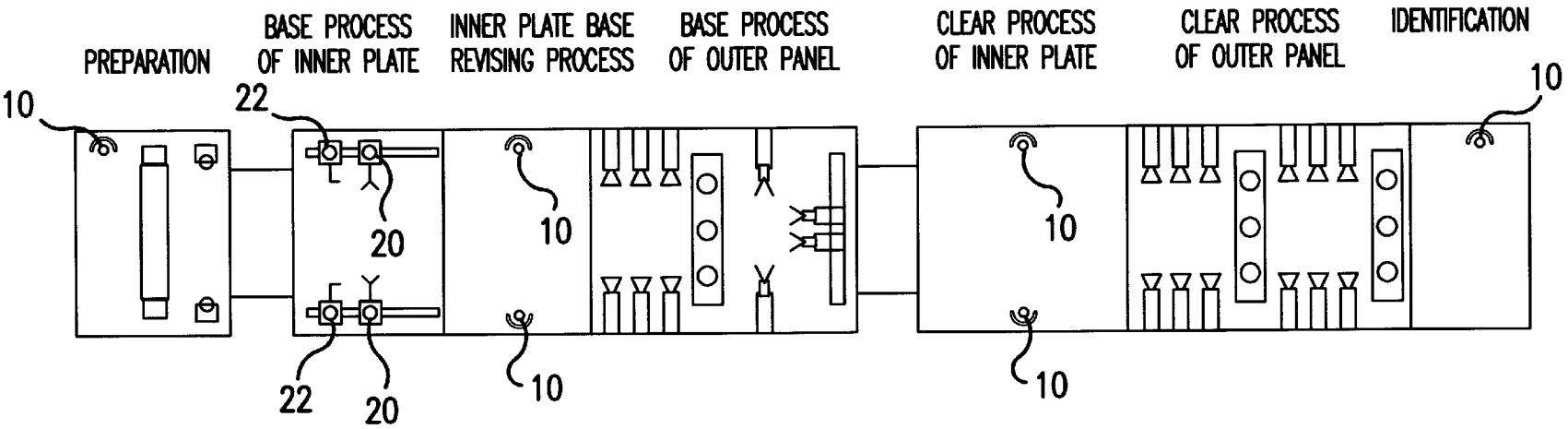
FIG.6 PRIOR ART
FIG.6 is a schematic diagram of a prior painting booth.

FIGS. 1 to 5 show an apparatus for painting the door of a vehicle in accordance with the present invention.

As shown in the above FIGS., the apparatus in accordance with the present invention comprises a painting robot 30 having a door open/close jig 50, which. including a supporting bar 56 elastically supported by a spring 54 and a permanent magnet 52; and a holding unit 40 for a door panel having a height control cylinder 46 for controlling the height thereof, a moving cylinder 48 for holding or releasing the door opened, a rotor 44 connected with the moving cylinder. 48, and a guide shaft 43 mounted on an end of the rotor 44 and having a holder 45 provided a plurality of recesses for holding the door panel on its end.

The supporting bar 56 mounted on the door open/closing jig 50 is made of urethane material.

The holder 45 mounted on the guide shaft 43 of the holding unit 40 is releasably engaged with the guide shaft 43 through a teeth portion 47 and made of acetal resin material.

The painting robot 30 is used during the inner plate base process and the inner plate clear process and has a door open/close jig 50 in order to simultaneously carry out both the door opening and closing work and the painting work.

The door open/close jig 50 mounted under the painting robot 30 is bent at 90° on its end, and the bent portion of the jig 50 is moved to the inside of the door trim that is the inner plate of the door. The permanent magnet 52 mounted on the bent portion is adhered on the inner plate of the door.

Then the door of the vehicle is opened by moving the painting robot 30 toward the outside at the state that the bent portion of the jig is hung in the inside of the door.

The supporting bar 56 elastically mounted by the spring 54 on the bent portion of the jig 50 is used for closing the door, when the door is closed after that the painting work is finished.

At this time, since the supporting bar 56 is made of urethane material and elastically supported by the spring 54, scratching is avoided on the surface of the door when the door is closed by the supporting bar 56 of the jig 50.

Furthermore, the holding unit 40 has the height cylinder 46 and the moving cylinder 48 and holds the door opened while the painting work is done by the painting robot 30.

The height cylinder 46 controls the height of the jig 50 according to the height of the vehicle to be painted, and the moving cylinder 48 moves the holder 45 mounted on the end of the guide shaft 43 for fixing or releasing the door opened.

A cover 41 is covered on the height cylinder 46 and the moving cylinder 48 for securing thereof.

On the moving cylinder 48 is mounted the rotor 44, which is connected with the guide shaft 43 engaged with the holder 45 through the teeth portion 47.

The holder 45 has a plurality of recesses on its surface, which is engaged with the upper end of the plate of the door when the jig 50 is moved into the inside of the door and the moving cylinder 48 is worked downward according to the height of the vehicle.

Then, since the holder 45 is made of acetal resin material and engaged with the guide shaft 43 through the teeth portion, the holder 45 can be easily replaced on polluted by the paint.

Now, the operation of the apparatus in accordance with the present invention will be described.

The whole painting processes are prepared by the operator 10 in the preparation room. The inner plate of the door such as the doorframe or the door opening portion is painted by the holding unit 40 and the painting robot 30 having the door open/closing jig 50.

At this time, the painting robot 30 having the door open/close jig 50 is moved to the inside of the door and the magnet 52 mounted on the jig 50 is adhered to the door trim 2.

Then, the painting robot 30 is moved to the outside of the door and the door adhered to the painting robot 30 by the magnet 52 is opened.

Next, the cylinder 44, 46 and the rotor 48 of the holding unit 40 are operated, and the holder 45 holds the door opened while the painting work is done.

After the painting work is completely done, the cylinder 44, 46 and the rotor 48 is operated and the holder 45 is take away from the door frame to the original position.

Finally the supporting bar 56 provided on the jig 50 pushes the lower molding portion of the door panel 4 so as to close the door.

When the door is closed by the supporting bar 56, the surface of the door is not injured since the supporting bar 56 is made of urethane material that is soft and elastically supported by the spring 54.

Therefore, the door painted by the apparatus in accordance with the present invention does not need the revising work for the painting portion. And the vehicle can be directly transmitted to the next process and the door panel of the vehicle is painted.

And during the next process, the painting robot 30 and the holding unit 40 are used like that the inner plate base process.

And as final process of the painting work, the operator 10 cleans the painting portion of the door and confirms it.

As described above, since the painting apparatus in accordance with the present invention can open/close the door and keep the door opened by the holding unit provided on the painting robot, a separated door opening and closing robot that is expensive is not required.

Therefore, the painting apparatus of the vehicle in accordance with the present invention is simple and the revising work is not required.

What is claimed is:

1. An apparatus for painting the door of a vehicle comprising:

a painting robot having a door open/close jig, including a supporting bar elastically supported by a spring and a permanent magnet; and a holding unit for a door panel having a height control cylinder for controlling the height thereof, a moving cylinder for holding or releasing the door opened, a rotor connected with the moving cylinder, and a guide shaft mounted on an end of the rotor and having a holder provided with a plurality of recesses for holding the door panel on its surface.

2. An apparatus for painting the door of vehicle according to claim 1, wherein the door open/close jig is made of urethane material.

3. An apparatus for painting the door of vehicle according to claim 1, wherein the holder is releasably engaged with the guide shaft through a tooth portion.

4. An apparatus for painting the door of vehicle according to claim 1 wherein the holder is made of acetal resin material.

5. An apparatus for painting the door of vehicle according to claim 3, wherein the holder is made of acetal resin material.

* * * * *